United States Patent [19]

Nathaniel

[11] Patent Number: 5,013,035

[45] Date of Patent: May 7, 1991

[54] EXERCISE DEVICE

[76] Inventor: Keithley M. Nathaniel, P.O. Box 1052, St. Johns, Antigua

[21] Appl. No.: 441,525

[22] Filed: Nov. 27, 1989

[51] Int. Cl.[5] ..... A63B 21/04

[52] U.S. Cl. ..... 272/136; 272/62; 272/93; 272/135

[58] Field of Search ..... 272/62, 67, 68, 78, 272/93, 116, 125, 135, 136, 142-144, 900, DIG. 4

[56] References Cited

U.S. PATENT DOCUMENTS

| | | | |
|---|---|---|---|
| D. 254,143 | 2/1980 | De Bock | 272/136 X |
| 552,971 | 1/1896 | Sandow | 272/136 X |
| 935,854 | 10/1909 | Linerode . | |
| 4,241,914 | 12/1980 | Bushnell | 272/62 X |
| 4,519,605 | 5/1985 | Leland | 272/116 |

*Primary Examiner*—Richard J. Apley
*Assistant Examiner*—Joe H. Cheng
*Attorney, Agent, or Firm*—Jerry T. Kearns

[57] ABSTRACT

An exercise device includes a pair of spaced parallel base members adapted for support on a horizontal floor surface. A cross member is secured transversely between midpoints of the base members and a pair of spaced parallel vertical posts extend upwardly from central positions on the base members. A plurality of diagonal braces extend between the base members and an associated post. A plurality of pairs of attachment loops are secured at various spaced locations on the posts and on transverse cross members for attachment of extension members. The extension members may be formed from an elastomeric rubber material or by a metallic coil spring. In either case, a clip is provided on one end of each of the extension members and a hand grip is provided on an opposite end. The exercise device can be disassembled for portability and allows two individuals to perform simultaneous workouts in a minimum amount of space.

3 Claims, 3 Drawing Sheets

EXERCISE DEVICE

BACKGROUND OF THE INVENTION

1. Field of the Invention

The present invention relates to exercise devices, and more particularly pertains to an exercise device of the type which utilizes the restorative spring force of an extensible member to provide a resistance force to develop muscles of an individual.

2. Description of the Prior Art

Various types of exercise devices are known in the prior art. A typical example of such an exercise device is to be found in U.S. Pat. No. 552,971, which issued to E. Sandow on Jan. 14, 1896. This patent discloses an exercise device having a pipe frame construction including a pair of spaced vertical posts and a transverse cross member. Elastomeric extension members are utilized to provide a resistance force for exercising leg muscles of a seated individual. U.S. Pat. No. 935,854, which issued to W. Linerode on Oct. 5, 1909, discloses an exercise device which includes a seat formed on a transverse pivotal beam. Coil springs are utilized to provide a restorative resistance force. U.S. Pat. No. 254,143, which issued to J. de Bock on Feb. 5, 1980, discloses an exercise device having a open box-like configuration formed by a plurality of vertical posts in horizontal brace members. Coil spring extension members include hand grips for providing a restorative resistance force. U.S. Pat. No. 4,241,914, which issued to D. Bushnell on Dec. 30, 1980, discloses an exercise device which utilizes elastomeric members secured to an open rectangular frame. U.S. Pat. No. 4,519,605, which issued to R. Leland on May 28, 1985, discloses an exercise device having an open box-like frame configuration formed by a plurality of horizontal and vertical tubular frame members. Extensible coil springs provide a resistance force and include hand grip members.

While the above mentioned devices are directed to exercise devices, none of these devices disclose the provision of a plurality of attachment loops at spaced locations on a frame to enable a pair of individuals to simultaneously workout in a minimum amount of space. Inasmuch as the art is relatively crowded with respect to these various types of exercise devices, it can be appreciated that there is a continuing need for and interest in improvements to such exercise devices, and in this respect, the present invention addresses this need and interest.

SUMMARY OF THE INVENTION

In view of the foregoing disadvantages inherent in the known types of exercise devices now present in the prior art, the present invention provides an improved exercise device. As such, the general purpose of the present invention, which will be described subsequently in greater detail, is to provide a new and improved exercise device which has all the advantages of the prior art exercise devices and none of the disadvantages.

To attain this, a representative embodiment of the concepts of the present invention is illustrated in the drawings and makes use of an exercise device which includes a pair of spaced parallel base members adapted for support on a horizontal floor surface. A cross member is secured transversely between midpoints of the base members and a pair of spaced parallel vertical posts extend upwardly from central positions on the base members. A plurality of diagonal braces extend between the base members and an associated post. A plurality of pairs of attachment loops are secured at various spaced locations on the posts and on transverse cross members for attachment of extension members. The extension members may be formed from an elastomeric rubber material or by a metallic coil spring. In either case, a clip is provided on one end of each of the extension members and a hand grip is provided on an opposite end. The exercise device can be disassembled for portability and allows two individuals to perform simultaneous workouts in a minimum amount of space.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved exercise device which has all the advantages of the prior art exercise devices and none of the disadvantages.

It is another object of the present invention to provide a new and improved exercise device which may be easily and efficiently manufactured and marketed.

It is a further object of the present invention to provide a new and improved exercise device which is of a durable and reliable construction.

An even further object of the present invention is to provide a new and improved exercise device which is susceptible of a low cost of manufacture with regard to both materials and labor, and which accordingly is then susceptible of low prices of sale to the consuming public, thereby making such exercise devices economically available to the buying public.

Still yet another object of the present invention is to provide a new and improved exercise device which provides in the apparatuses and methods of the prior art some of the advantages thereof, while simultaneously overcoming some of the disadvantages normally associated therewith.

Still another object of the present invention is to provide a new and improved exercise device which utilizes attachment loops at various spaced locations in conjunction with selectively positionable extension members to provide a complete body workout.

Yet another object of the present invention is to provide a new and improved exercise device which enables a pair of individuals to simultaneously workout in a minimum amount of space.

Even still another object of the present invention is to provide a new and improved exercise device which is conveniently disassembled for storage and transportation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
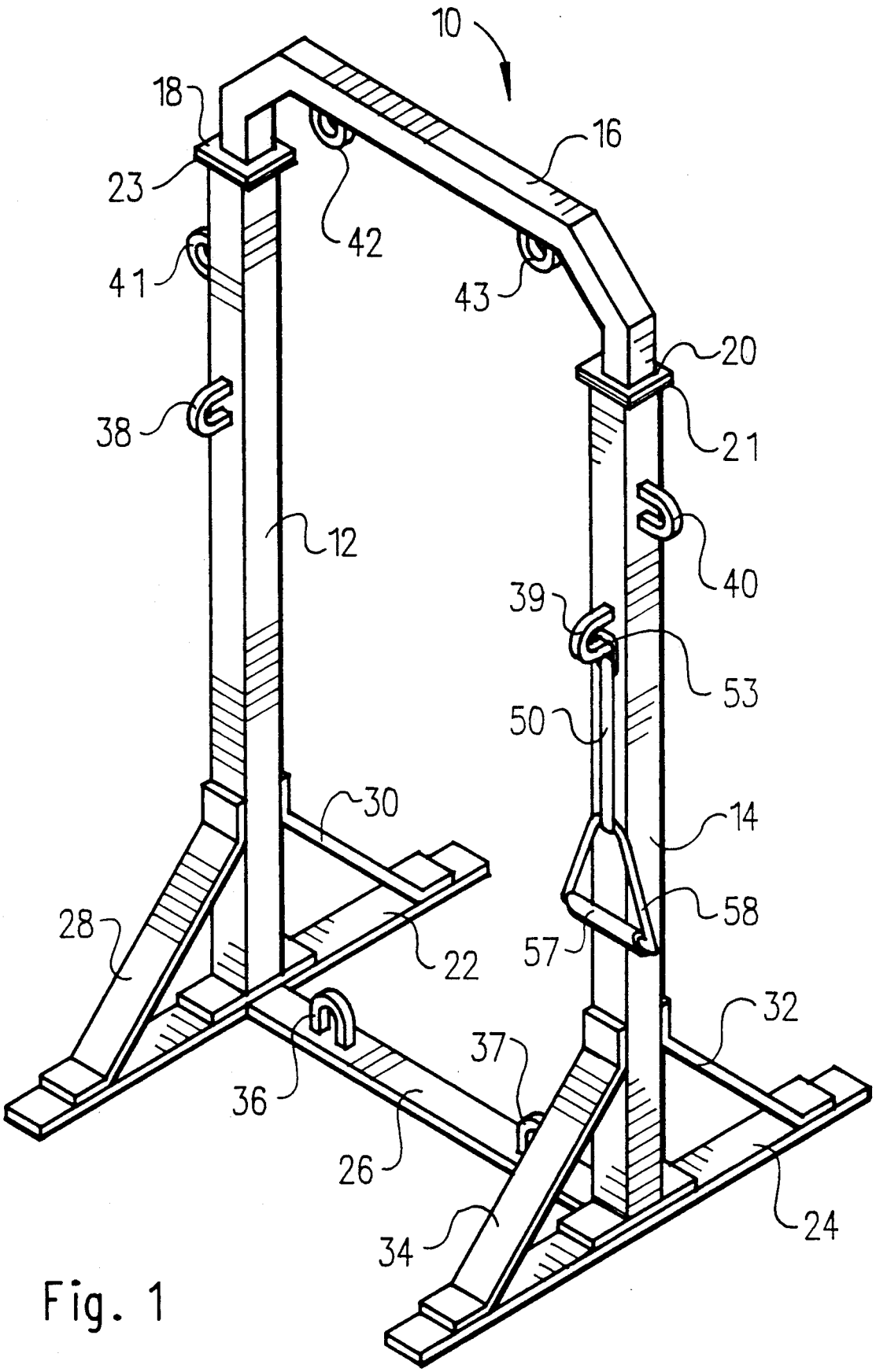
FIG. 1 is a perspective view of the exercise device according t the present invention.

With reference now to the drawings, and in particular to FIG. 1 thereof, a new and improved exercise device embodying the principles and concepts of the present invention and generally designated by the reference numeral 10 will be described.

More specifically, it will be noted that the first embodiment 10 of the invention includes a pair of spaced parallel base members 22 and 24 adapted for support on a horizontal floor surface. A cross member 26 is secured transversely between midpoints of the base member 22 and 24 and a pair of spaced parallel vertical posts 12 and 14 extend upwardly from upper central positions on the base members 22 and 24. A pair of diagonal brace members 28, 30, 32 and 34 extend between each of the base members 22 and 24 and an associated one of the posts 12 and 14. A first pair of attachment loops 36 and 37 are secured in spaced parallel relation on an upper surface of the cross member 26. A second pair of attachment loops 38 and 39 are secured in vertical alignment on front faces of the posts 12 and 14. A third pair of attachment loops 40 and 41 are secured in vertical alignment on side faces of the posts 12 and 14, above the second pair of loops 38 and 39. Upper ends of the posts 12 and 14 are provided with a first pair of flanges 21 and 23. The flanges 21 and 23 are dimensioned for mating engagement with a second pair of flanges 18 and 20 formed at opposite ends of a transverse top bar 16. A fourth pair of attachment loops 42 and 43 are secured on a bottom face of the top bar 16. An extension member 50 is preferably formed from an elastomeric material such as rubber, or alternatively from a coil spring to provide a restorative spring resistance force. A clip 53 is provided for removably securing the extension member 50 a selected one 39 of the various attachment loops. The opposite end of the extension member 50 terminates in a triangular loop 58 having a hand grip portion 57. In use, a pair of extension members 50 are utilized, and are engaged in selected aligned attachment loops. By selectively positioning the extension members sequentially on the various pairs of attachment loops, an individual may exercise a wide variety of different muscle groups by stretching the extension members utilizing muscular force. Because of the plurality of attachment loops, a pair of individuals may perform a workout simultaneously on the exercise device 10. The posts 12 and 14 and the top bar 16 preferably provide a height for the entire device of about 6 feet. The lateral spacing between the posts 12 and 14 is preferably about 3 feet. It should be noted that an additional pair of attachment loops may be provided on a back face of each of the posts 12 and 14, opposite the loops 38 and 39. This allows the use by a second individual when the loops 38 and 39 are utilized by an individual on the front side of the exercise device 10. When utilized by two individuals simultaneously, it will be understood that an additional set of extension members will be employed. The various components comprising the frame of the exercise device 10 are preferably formed from a steel material and the various attachment loops may be conveniently provided utilized EYE bolts.

Figure 2:
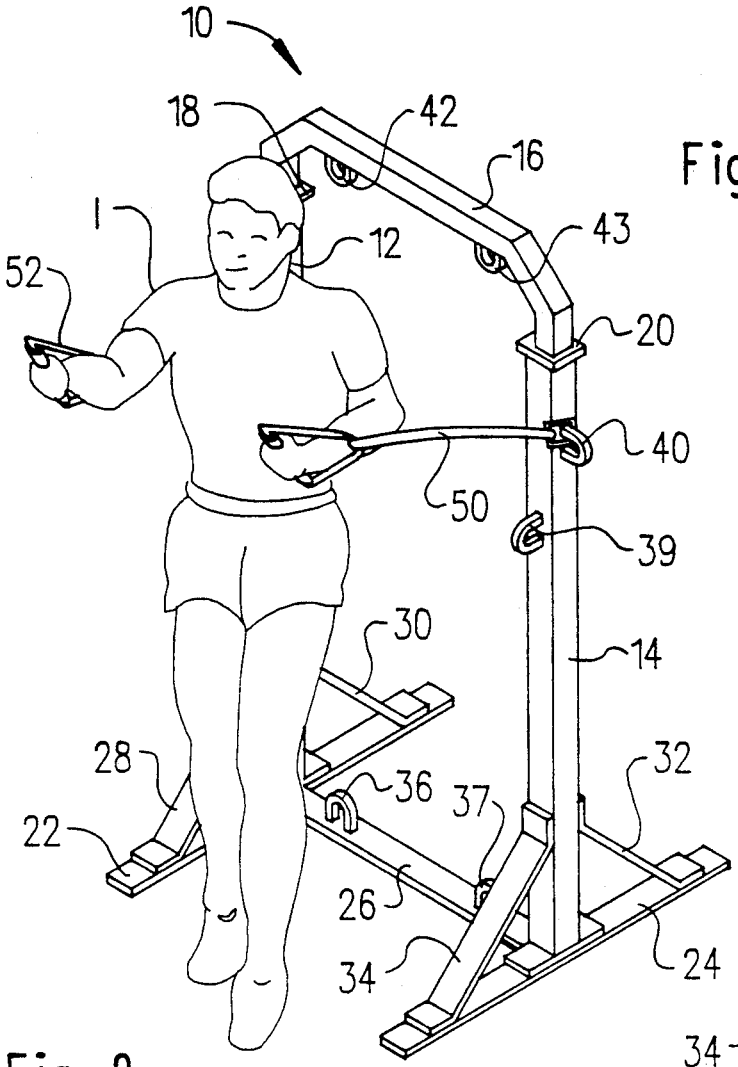
FIG. 2 is a perspective view illustrating the manner of use of the exercise device of the present invention.

FIG. 2 illustrates the manner of use of the exercise device 10 by an individual I employing a pair of elastomeric extension members 50 and 52.

Figure 3:
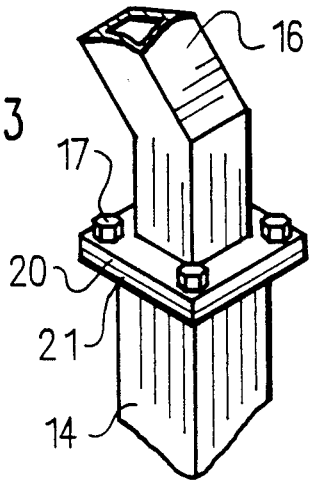
FIG. 3 is a partial perspective detail view illustrating the assembly of the top cross member to a vertical post of the exercise device.

As shown in FIG. 3, the abutting flanges 20 and 21 of the top bar 16 and post 14 are preferably secured by a pluralitY of threaded fasteners 17 to allow expedient disassembly for storage and transportation purposes.

Figure 4:
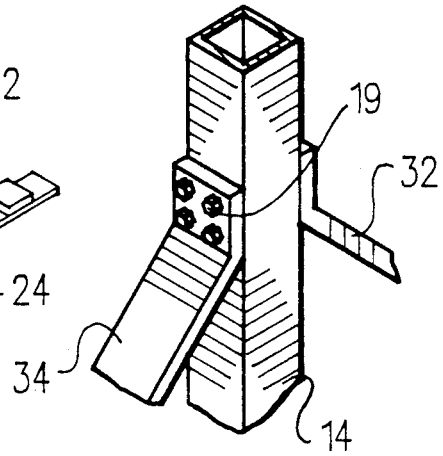
FIG. 4 is a partial perspective detail view illustrating the attachment of diagonal brace members to a vertical post of the exercise device.

Similarly, as shown in FIG. 4, the top ends of the diagonal braces 34 are secured by a plurality of threaded fasteners 19 to the post 14.

Figure 5:
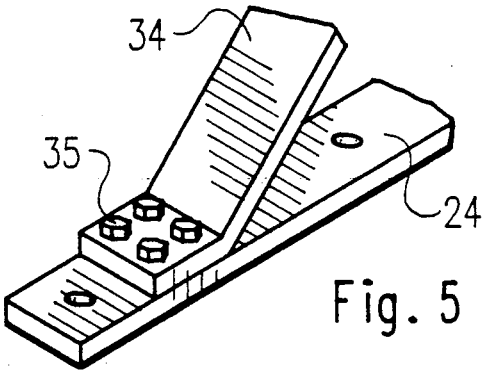
FIG. 5 is a partial perspective detail view illustrating the attachment of a diagonal brace of a horizontal base member of the exercise device.

As shown in FIG. 5, the bottom ends of each of the diagonal braces 34 is preferably secured to a respective one of the base members 24 utilizing threaded fasteners 35.

Figure 6:
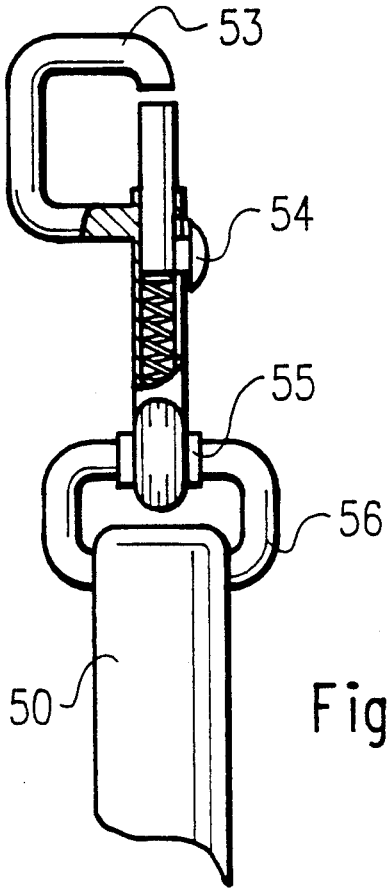
FIG. 6 is a plan view, partially cut away and in cross section, which illustrates a first elastomeric extension member utilized in the exercise device of the present invention.

FIG. 6 illustrates the construction of the attachment clip 53 provided at one end of the elastomeric extension member 50. A metal loop 56 is provided, for example by extension through a loop or aperture formed in the rubber extension member 50, and includes a rotary journal bearing 55. The body of the clip 53 is thus pivotally mounted with respect to the loop 56. A spring bias latch member 54 is manually manipulable to allow engagement of the clip 53 with a selected attachment loop.

Figure 7:
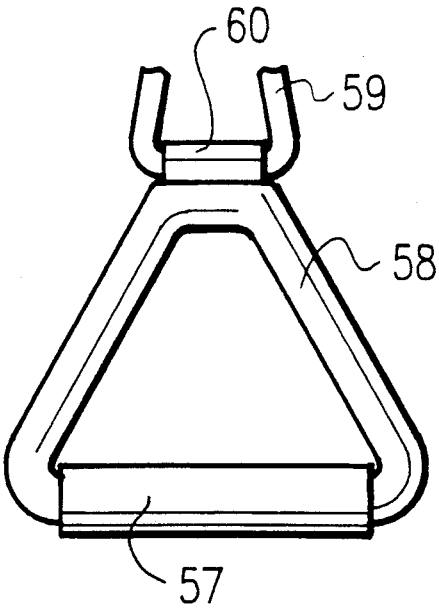
FIG. 7 is a detail view illustrating an extension member hand grip portion.

FIG. 7 illustrates the constructional details of the hand grip portion of an extension member. A metal loop 59 is secured to an end of the elastomeric portion of the extension member and provides a bearing surface for a tubular cylindrical portion 60 connected to an end of a triangular loop member 58. This provides a rotary connection of the triangular loop 58 with respect to the attachment loop 59. A hand grip 57, for example formed from a resilient plastic or rubber material, is provided on the triangular loop 58 to enhance comfort of a user.

Figure 8:
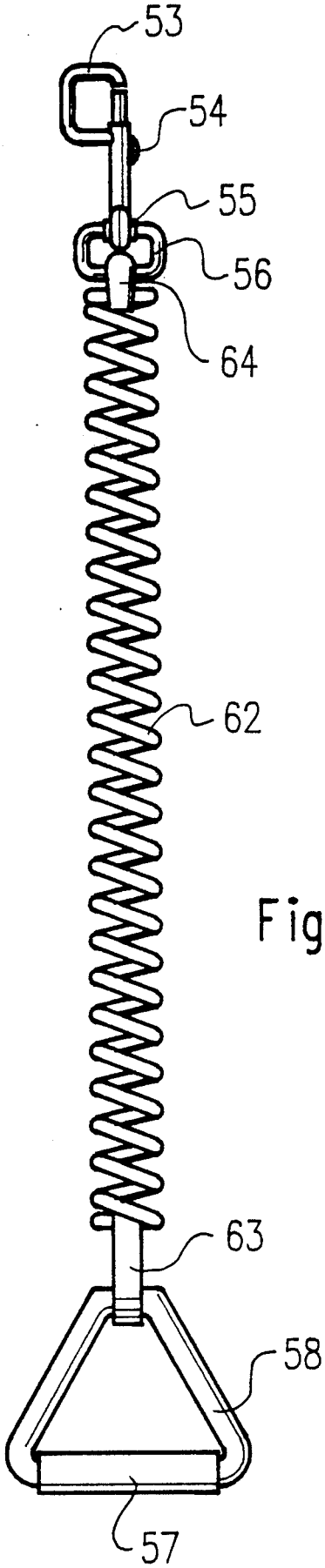
FIG. 8 is a plan view illustrating a second extension member which utilizes a coil spring to provide a restorative resistance force.

FIG. 8 illustrates an alternative extension member 62, preferably formed an elongated metal coil spring. The spring constant may be suitably selected to provide a desired degree of resistance. Attachment loops 63 and 64 are provided at opposite ends of the coil spring 62, and are in engagement with the triangular hand grip loop 58 and the clip attachment loop 56. It is contemplated that a pair of the spring type extension member 62 and a pair of the previously described elastomeric rubber extension members will be initially provided as a set including the frame of the exercise device.

As may now be understood, the present invention provides a relatively inexpensive and easily portable exercise device which may be utilized by two individuals to perform simultaneous workouts in a minimum amount of space.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the U.S. is as follows:

1. An exercise device, comprising:

a pair of spaced parallel base members adapted for support on a horizontal surface;

a cross member secured transversely between midpoints of said base members;

a pair of spaced parallel vertical posts, each of said vertical posts extending upwardly from an upper central position on each one of said base members, and wherein each of said vertical posts having a height of about 6 feet;

a pair of diagonal brace members, each of said diagonal brace members extending between each ends of each one of said base members and an associated one of said vertical posts;

a first pair of upstanding attachment loops secured in spaced relation on said cross member;

a second pair of attachment loops secured in vertical alignment on front faces of said vertical posts, wherein one of said second pair of attachment loops secured to one of said vertical posts and another of said second pair of attachment loops secured to another of said vertical posts;

a third pair of attachment loops secured in vertical alignment on side faces of said vertical posts, above said second pair of attachment loops, wherein one of said third pair of attachment loops secured to one of said vertical posts, and another of said third pair of attachment loops secured to another of said vertical posts;

said first, second, and third pairs of attachment loops extending in three orthogonal directions;

a first pair of flanges, one of said first pair of flanges formed on an upper end of one of said vertical posts, and another of said first pair of flanges formed on an upper end of another one of said vertical posts;

a transverse top bar having opposite ends terminating in a second pair of flanges, one of said second pair of flanges disposed at one of said opposite ends of said transverse top bar and another of said second pair of flanges disposed at another of said opposite ends of said transverse top bar, said second pair of flanges dimensioned for aligned engagement with said first pair of flanges, said top bar disposed at a vertical elevation about equal to the height of an intended user;

a plurality of threaded fasteners removably securing said first and second pair of flanges, whereas said transverse top bar extending above and between said vertical posts;

a fourth pair of attachment loops secured on a bottom face of said top bar;

and at least one pair of elastic extension members, each of said extension members having a first end terminating in a clip for engagement with a selected one of said attachment loops and an opposite end terminating in a hand grip for providing a wide variety of exercises.

2. The exercise device of claim 1, wherein said extension members are formed from a rubber material.

3. The exercise device of claim 1, wherein said extension members are formed from a coil spring.

* * * * *